US005291158A

United States Patent [19]

Blair et al.

[11] Patent Number: 5,291,158

[45] Date of Patent: Mar. 1, 1994

[54] HIGH FREQUENCY FILTER HAVING COMMON COUPLING RODS FIXEDLY MOUNTED AND COUPLED THROUGH A COMMON WALL

[75] Inventors: William D. Blair, Lanoka Harbor; Salvatore Bentivenga, Parlin, both of N.J.

[73] Assignee: Radio Frequency Systems, Inc., Marlboro, N.J.

[21] Appl. No.: 814,375

[22] Filed: Dec. 26, 1991

[51] Int. Cl.[5] ..... H01P 5/12; H01P 1/205

[52] U.S. Cl. ..... 333/126; 333/134; 333/203

[58] Field of Search ..... 333/124–127, 333/132, 134, 135, 202, 203, 208, 212

[56] References Cited

U.S. PATENT DOCUMENTS

| | | | |
|---|---|---|---|
| 3,818,389 | 6/1974 | Fisher | 333/203 |
| 4,121,181 | 10/1978 | Nishikawa et al. | 333/134 X |
| 4,660,004 | 4/1987 | Jachowski | 333/203 X |
| 4,890,078 | 12/1989 | Radcliffe | 333/134 |
| 4,937,533 | 6/1990 | Livingston | 333/203 X |
| 4,980,662 | 12/1990 | Simon et al. | 333/134 |
| 5,023,579 | 6/1991 | Bentivenga et al. | 333/203 |
| 5,151,670 | 9/1992 | Blair et al. | 333/126 |

FOREIGN PATENT DOCUMENTS

| | | | |
|---|---|---|---|
| 3028925 | 2/1982 | Fed. Rep. of Germany | 333/134 |

*Primary Examiner*—Seungsook Ham

[57] ABSTRACT

A technique for directly coupling multiple high frequency resonant cavity filters includes a common port 62 that is directly coupled to a coupling rod 76 that is mounted within a first high frequency resonant cavity filter housing 64 of a housing assembly 60. The coupling rod 76 is directly coupled by a conductor 74 to an coupling rod 72 that is mounted within a second high frequency resonant cavity filter housing 66. The conductor 74 passes through an opening 78 in a common wall 80 between the first 64 and the second 66 high frequency resonant cavity filter housings. Thus, both filters 64, 66 are directly coupled to the common port 62.

4 Claims, 4 Drawing Sheets

HIGH FREQUENCY FILTER HAVING COMMON COUPLING RODS FIXEDLY MOUNTED AND COUPLED THROUGH A COMMON WALL

BACKGROUND OF THE INVENTION

1. Field of the Invention

The present invention relates to high frequency resonant cavity filters and, more particularly, to a technique for directly coupling multiple high frequency resonant cavity filters to a common port.

2. Description of the Prior Art

The use of a resonant cavity for high frequency filtering purposes is well known in the art. A resonant cavity housing generally contains a pair of coupling rods and a plurality of resonators. The size of such a housing generally depends upon the number of resonator rods within the housing that are required for a desired filtering characteristic. Often, as the number of resonator rods is increased to meet a narrow bandwidth resonant frequency requirement, the size of the resonant cavity housing will exceed a standard rack mounting dimension. It is therefore desirable to efficiently design the resonant cavity housing such that its physical size conforms to standard rack mounting dimensions.

It has been previously shown, in the U.S. Pat. No. 5,151,670, that it is also desirable to combine multiple high frequency filters into a single resonant cavity housing. A multiplexing resonant cavity housing allows multiple filters to use a common port, and thus the number of lossy external feedline cables is decreased. The Duplexing Filter combines two high frequency filters into one resonant cavity housing such that a common coupling rod, that is connected to an external port, is shared. The common coupling rod is positioned at the center of the cavity housing and a plurality of resonator rods are positioned outward from this center coupling rod position. Separate coupling rods for each filter are positioned at opposite ends of the cavity housing, such that each filter's resonator rods are positioned between their respective separate coupling rod and the common coupling rod. Again, however, as the number of resonator rods is increased to meet the higher selectivity requirements of the filter, the length size of the resonant cavity housing often exceeds the standard rack mounting dimensions.

The present invention maintains the benefit of allowing multiple high frequency resonant cavity filters to use a common port, while conforming the size of the multiple filter assembly to standard rack mounting dimensions.

SUMMARY OF THE INVENTION

The present invention contemplates a means for directly coupling multiple high frequency resonant cavity filters to a common port, while conforming the size of the multiple filter assembly to a standard rack mounting dimension. The direct coupling of, for example, two high frequency resonant cavity filters to a single external port allows a duplexing filter to decrease its length by approximately one half while doubling its width.

In the preferred embodiment of the present invention, a first resonant cavity housing is constructed for a single high frequency filter. Inside this housing, two coupling rods are positioned at opposite ends of the housing and a plurality of resonator rods are positioned in between these coupling rods. Each of the coupling rods is connected to its own external port. A small diameter hole is formed in one wall of the housing near one of the coupling rods, the common coupling rod, and a conductor is placed through this hole and attached to the common coupling rod. The conductor serves to connect the common coupling rod to a coupling rod of another high frequency filter.

A second resonant cavity housing is constructed for another high frequency filter. Again, this housing contains two coupling rods and a plurality of resonator rods. However, only one of the coupling rods is connected to an external port. A small diameter hole is formed in one wall of the housing near the unported coupling rod. This hole is situated such that when the two resonant cavity housings are side-abutted next to one another, the conductor attached to the common coupling rod in the first resonant cavity housing is attached to the unported coupling rod in the second resonant cavity housing. Thus, the external port of the common coupling rod is directly coupled to the coupling rods of both high frequency filters. Furthermore, the length of the assembly of the two side-abutted resonant cavity housings is approximately one half the length of two end-abutted resonant cavity housings.

It is easily seen how the technique described above for a duplexing high frequency resonant cavity filter can be extended to accommodate multiple filters within the scope of this invention.

A primary object of the present invention is to provide a technique for directly coupling multiple high frequency resonant cavity filters to a common port.

Another object of the present invention is to provide an assembly of multiple high frequency resonant cavity filters that physically conform to standard rack mounting dimensions.

Another object of the present invention is to provide a multiplexing high frequency resonant cavity filter with a common port.

DETAILED DESCRIPTION OF THE INVENTION

Figure 1:
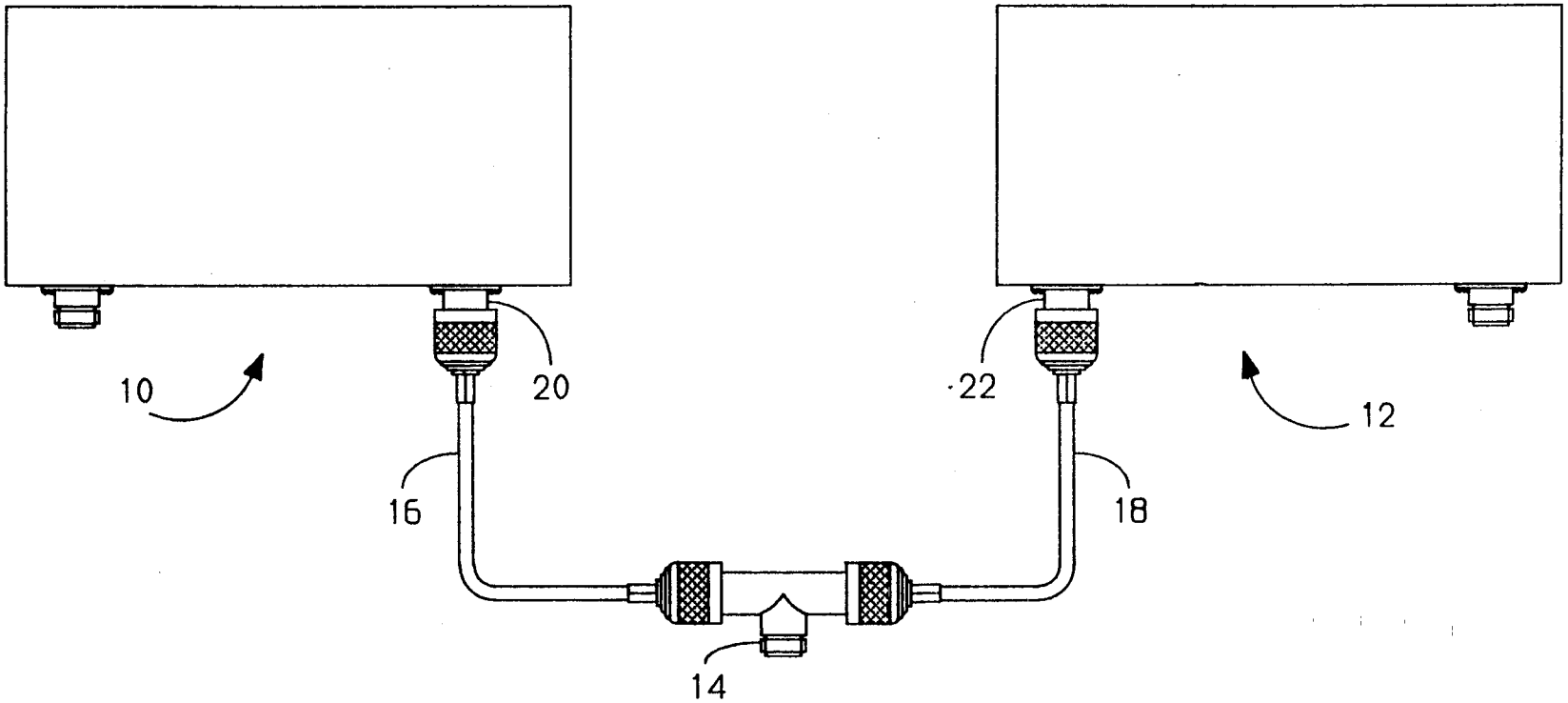
FIGURE 1 (PRIOR ART)
FIG. 1 shows a prior art technique whereby two high frequency resonant cavity filters are tied to a common port with a pair of critical length cables.

FIG. 1 illustrates a prior art technique whereby multiple high frequency resonant cavity filters are tied to a common port 14. As shown in FIG. 1, two high frequency resonant cavity filters 10, 12 are connected to a common port 14 with a pair of critical length cables 16, 18, respectively. The length of the cables 16, 18 is chosen to transform the input impedance at a port of each filter 20, 22, respectively, to an open circuit at the common port 14. These cables 16, 18, however, induce signal losses due to an inherent cable impedance. Also, the cables 16, 18 tend to reduce the bandwidth capability of the filters 10, 12 due to a multiple amount of nulls in the frequency response of the cables 16, 18.

Figure 2:
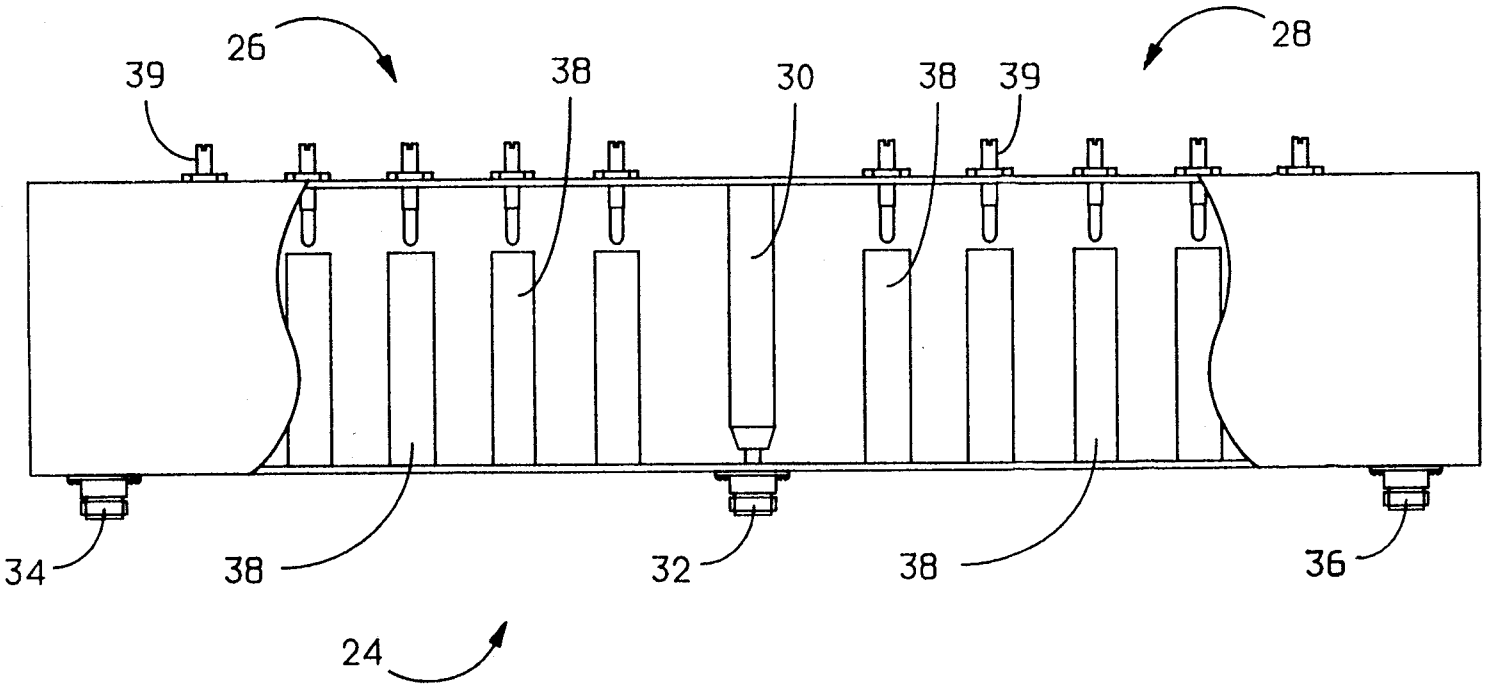
FIGURE 2 (PRIOR ART)
FIG. 2 shows a prior art duplexing high frequency resonant cavity filter.

To overcome the above-stated restraints of critical length cables, it is possible to combine multiple high frequency filters into a single resonant cavity housing 24, as shown in FIG. 2. This invention, further described in the co-pending patent application Ser. No. 07/686,325 (U.S. Pat. No. 5,151,670), entitled, Duplexing Filter, filed on Apr. 10, 1991, assigned to the present assignee and hereby incorporated by reference, shows two high frequency filters 26, 28, sharing a common coupling rod 30 and port 32. Each filter 26, 28 has one individual port 34, 36 at a respective end of the cavity housing 24. A plurality of resonator rods 38 are positioned between the common coupling rod 30 and each filter's respective individual port 34, 36. Also, associated with the plurality of resonator rods 38, there is a like plurality of tuning rods 39 for the purpose of fine tuning each filter's frequency characteristics. This duplexing method alleviates the problems associated with critical length cables, however, as the number of resonator rods 38 is increased to meet higher selectivity requirements, the length of the Duplexing Filter exceeds standard rack mounting dimensions.

Figure 3:
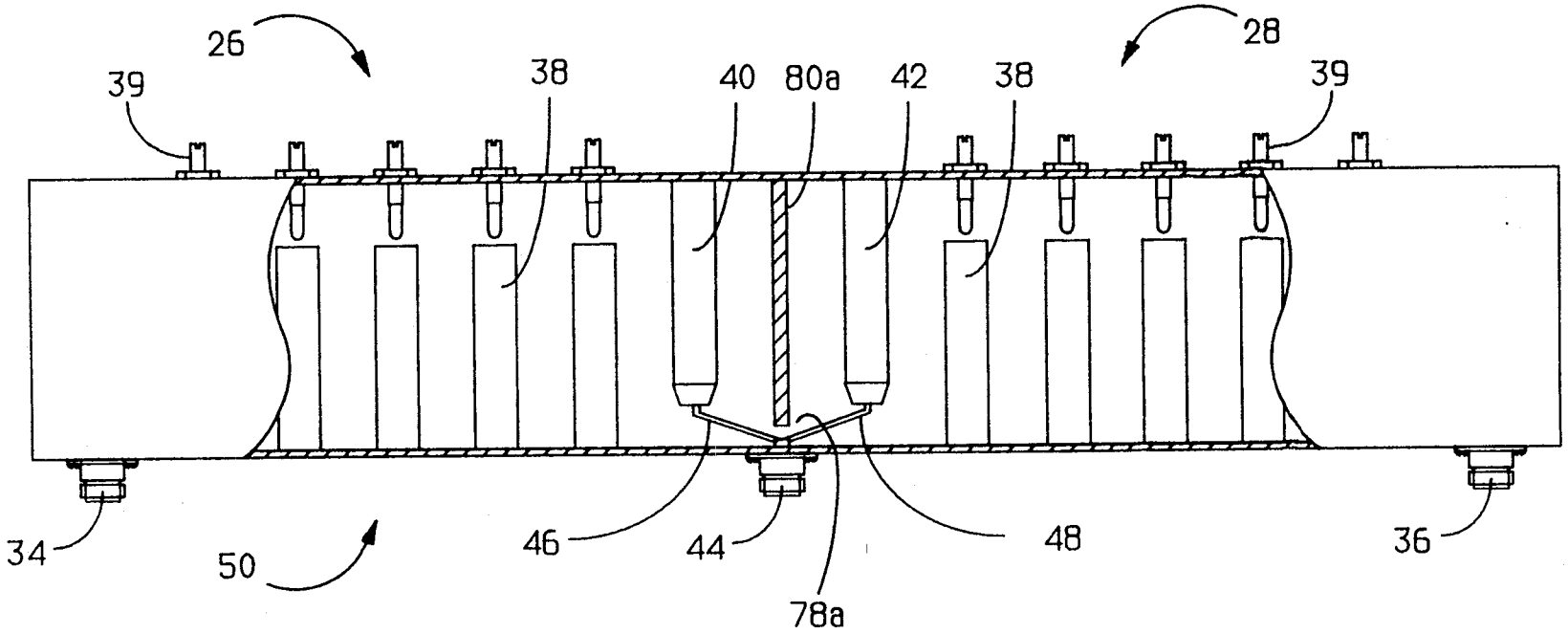
FIG. 3 is a first realization of a directly coupled multiplexing filter.

The present invention incorporates the benefits of allowing multiple high frequency resonant cavity filters to share a common port without the use of critical length cables, while conforming the multiple filter assembly to standard rack mounting dimensions. This invention is first realized by understanding that an impedance of the common coupling rod 30 in FIG. 2 is not a significant factor in producing a proper frequency response in the duplexed filters 26, 28. Therefore, the single common coupling rod 30 shown in FIG. 2 is considered to be two independent common coupling rods 40, 42 as shown in FIG. 3. These two independent coupling rods 40, 42, are isolated from each other except where they are tied to a common port 44 by any appropriate means that does not affect the impedance matching from the common coupling port 44 to either coupling rod 40, 42. In this case, two copper wires 46, 48 are used to directly couple the coupling rods 42, 40 to the common port 44, respectively through aperture **78*a* of partition 80*a*, as shown in FIG. 3. All other components of the resonant cavity housing 50 shown in FIG. 3 are like those shown in FIG. 2**, and thus are numerically identified as such.

Figure 4:
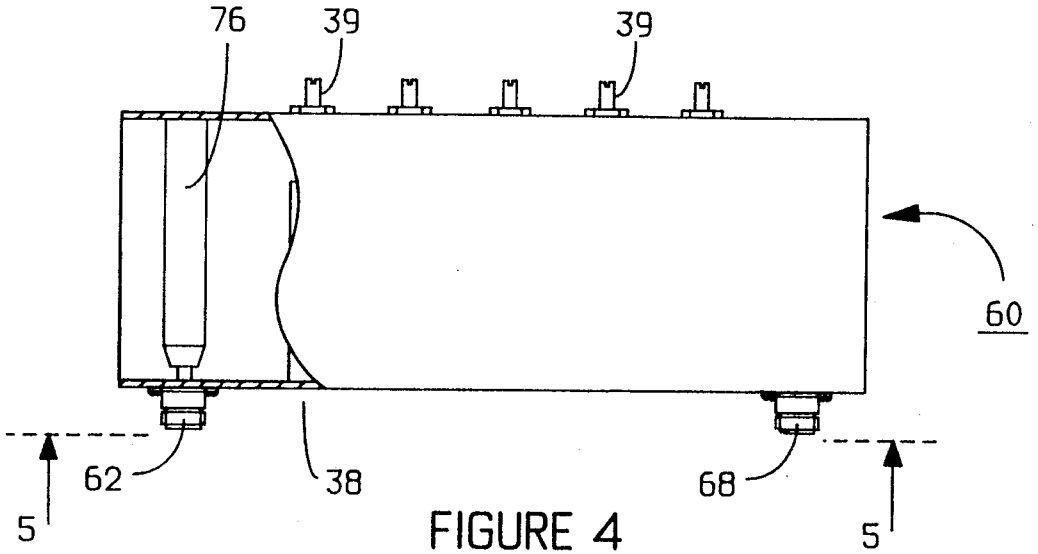
FIG. 4 is a side view of a directly coupled multiplexing filter taken along line 4—4 of FIG. 5.
Figure 5:
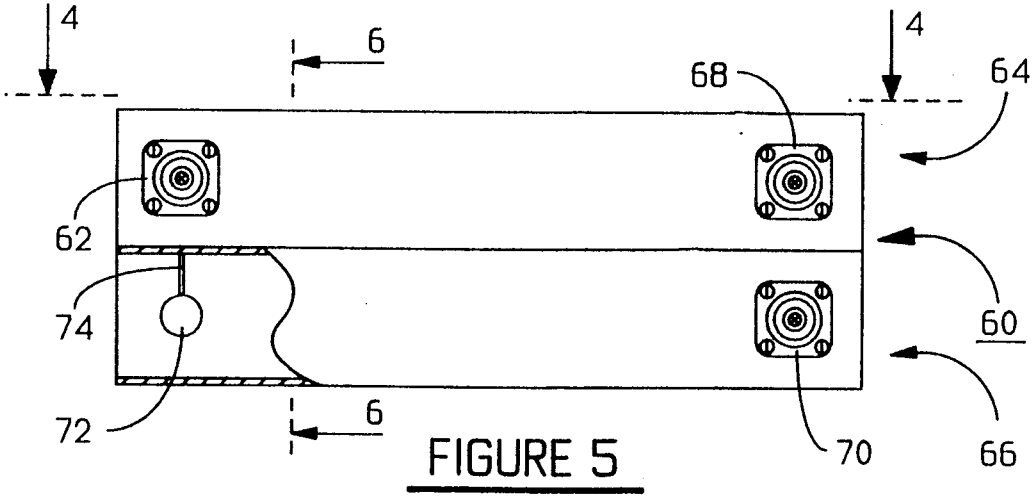
FIG. 5 is a bottom view of a directly coupled multiplexing filter taken along line 5—5 of FIG. 4.
Figure 6:
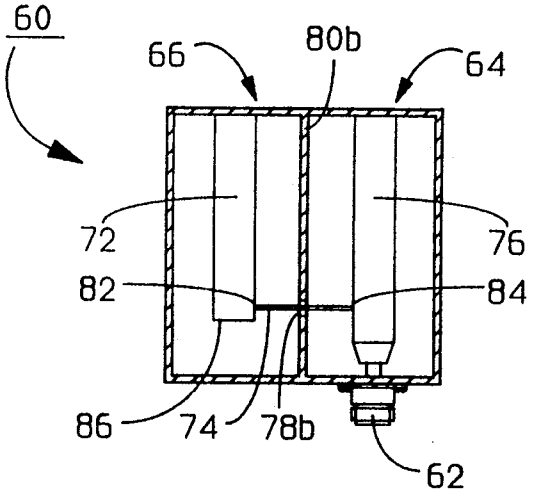
FIG. 6 is a cross-sectional end view of a directly coupled multiplexing filter taken along line 6—6 of FIG. 5.

A final realization of the present invention is shown in different views in FIGS. 4, 5 and 6. Referring first to FIG. 4, there is shown a side view of a dual multiplexing filter 60. This dual multiplexing filter 60, or duplexer, contains two high frequency resonant cavity filters, situated adjacent to one another, that share a common port 62. A plurality of resonator rods 38 and tuning rods 39 are again provided for each filter. It is easily seen that the length of the duplexer shown in FIG. 4 is approximately one half the length of the duplexers shown in FIGS. 2 and 3. Accordingly, the size of the duplexer shown in FIG. 4 conforms to standard rack mounting dimensions.

Referring to FIG. 5, a bottom view of the duplexer 60 is shown. The two adjacent filters 64, 66 each have an individual port 68, 70, respectively, in addition to the common port 62. A cutaway view shows a coupling rod 72 in a first filter 66, being directly coupled toward a second filter 64 by means of a conductor 74, in this case a copper wire. Referring to FIG. 6, there is shown the coupling rod 72 of the first filter 66 being directly coupled to a coupling rod 76 of the second filter 64, by the copper wire 74. The copper wire 74 passes through a hole **78*b* in a common wall 80*b* of the duplexer housing. The coupling rod 76 of the second filter 64 is directly coupled to the common port 62. Thus, both coupling rods 72, 76 are directly coupled to the common port 62**.

When designing such a direct coupled multiplexing filter 60, the location where a conductor taps into the coupling rods 72, 76 is critical for proper filter operation. The location of a conductor tap point 82 on the coupling rod 72 of the first filter 66 should be as close to the open end of the coupling rod 86 as possible. This positioning reduces an added impedance affect resulting from an open ended portion of the coupling rod 72 acting as a transmission line stub. A conductor tap point location 84 on the coupling rod 76 of the second filter 64 is chosen so as to provide an optimum impedance match from the common port 62 to both filters 64, 66.

It should be noted that although FIG. 6 depicts the multiplexing filter 60 as being contained in one dual housing, it is also possible to have separate filter housings precisely aligned and secured alongside one another. This scheme allows for the interchangeability of groups of different types of filters.

It is thus seen that the objects set forth above are efficiently attained and, since certain changes may be made in the above described technique without departing from the scope of the invention, it is intended that all matter contained in the above description or shown in the accompanying drawings shall be interpreted as illustrative and not in a limiting sense.

What is claimed is:

1. A high frequency filter assembly having a plurality of input/output ports (62, 68, 70), comprising:

a housing assembly (24) having a common wall (**80*b*) with an aperture (78*b***);

a plurality of resonator rods (38) fixedly mounted within said housing assembly (24);

one of the plurality of input/output ports (62, 68, 70) being a common port (62) mounted to said housing assembly (24);

a plurality of common coupling rods (72, 76) fixedly mounted within said housing assembly (24); and means for directly coupling said common port (62) to said plurality of common coupling rods (72, 76) through the aperture (**78*b*) of said common wall (80*b*), by directly connecting a first one of the plurality of coupling rods (76) to the common port (62), and electrically connecting each remaining one of the plurality of coupling rods (72) to the first one of the plurality of common coupling rods (76) with a copper wire (74**) through said aperture.

2. A high frequency filter assembly as described in claim 1, wherein said housing assembly is formed of a plurality of high frequency resonant cavity filter housings, each being adjacent to another of said housings and sharing said common wall.

3. A high frequency filter assembly as described in claim 2, wherein a respective one of said plurality of common coupling rods is mounted within each of said plurality of high frequency resonant cavity filter housings.

4. A high frequency filter assembly as described in claim 3, wherein said common port is mounted to one of said plurality of high frequency resonant cavity filter housings.

* * * * *